United States Patent [19]

Antonious

[11] Patent Number: 5,014,993

[45] Date of Patent: May 14, 1991

[54] IRON TYPE GOLF CLUB HEAD

[76] Inventor: Anthony J. Antonious, 205 E. Joppa Rd., Towson, Md. 21204

[21] Appl. No.: 513,676

[22] Filed: Apr. 24, 1990

[51] Int. Cl.[5] ..... A63B 53/04

[52] U.S. Cl. ..... 273/169; 273/167 H

[58] Field of Search ..... 273/167-175, 273/77 R, 77 A, 164; D21/219, 220

[56] References Cited

U.S. PATENT DOCUMENTS

| | | | |
|---|---|---|---|
| 3,814,437 | 6/1974 | Winquist | 273/167 R |
| 4,326,326 | 4/1982 | MacDonald | 273/167 F X |
| 4,826,172 | 5/1989 | Antonious | 273/169 |
| 4,883,274 | 11/1989 | Hsien | 283/164 |
| 4,919,430 | 4/1990 | Antonious | 273/169 |
| 4,932,658 | 6/1990 | Antonious | 273/169 |
| 4,938,470 | 7/1990 | Antonious | 273/164 |

OTHER PUBLICATIONS

"Golf Digest" magazine, Dec. 1981 Issue, p. 63-add for American Golf.

"Golf World" magazine, Jan. 1983 issue, p. 23-ad for Standard Iron.

*Primary Examiner*—Edward M. Coven

*Assistant Examiner*—Sebastiano Passaniti

*Attorney, Agent, or Firm*—N. J. Aquilino

[57] ABSTRACT

A peripheral weighted, cavity back iron type golf club head having a secondary weight system formed within the cavity and attached to the peripheral mass at two separate and in-line points on the peripheral mass.

10 Claims, 4 Drawing Sheets

IRON TYPE GOLF CLUB HEAD

BACKGROUND OF THE INVENTION

The present invention relates to perimeter weighted golf club heads having a recessed or cavity back with an improved weight distribution and configuration. To improve the effeciency and playability of a golf club head, various designs in weight configurations have been developed over the years. Many conventional club heads concentrate the weight around the periphery of the golf club head, particularly at the bottom and heel and toe areas.

Various attempts at improving this weight configuration are shown in the prior art including my U.S. Pat. No. 4,826,172 which shows a perimeter weighted golf club head with a cavity back with additional weight members formed within the cavity on opposite sides of the center of gravity (CG) or the center of percussion (CP).

The present invention provides a peripheral weighted iron type golf club head having a recessed or cavity back with additional weight members designed and positioned to provide increased control and feel without sacrificing accuracy and distance. The additional weight members are formed within the cavity and have a plurality of at least two points which intersect and are integrally connected to the peripheral weight member. Various embodiments are contemplated including additional weight members which extend from two points within the cavity, from three points within the cavity and from four points within the cavity.

An object of the present invention is provide a peripheral weight iron type golf club which provides an improved weight configuration to enable a golfer to achieve better control, improved feel and accuracy and greater distance when hitting a golf ball.

Another object is provide an iron type golf club head with an improved weight configuration that minimizes variances in a golf ball's flight when a ball is hit off-center.

Still another object is to provide a weighting of a golf club head which provides additional weight in areas where a golf ball is most often miss-hit, thereby increasing the potential for the ball to go further and straighter when struck off of the center of gravity (CG) of the club head.

These and other objects will be understood with reference to accompanying description and drawings.

DESCRIPTION OF THE DRAWINGS FIG. 1 is a front elevational view of an iron type golf club head in accordance with the present invention. FIG. 2 is a rear perspective view thereof. FIG. 3 is a rear elevational view thereof. FIG. 4 is a rear perspective view of a second embodiment of the present invention. FIG. 5 is a rear elevational view of the club head of FIG. 4. FIG. 6 is a rear perspective view of a third embodiment of the present invention. FIG. 7 is a rear elevational view of the club head of FIG. 6. FIG. 8 is a rear perspective view of a fourth embodiment of the present invention. FIG. 9 is a rear elevational view of the club head of FIG. 8. FIG. 10 is a rear perspective view of a fifth embodiment of the present invention. FIG. 11 is a rear elevational view of the club head of FIG. 10. FIG. 12 is a rear perspective view of a sixth embodiment of the present invention. FIG. 13 is a rear elevational view of the club head of FIG. 12.

DESCRIPTION OF THE PREFERRED EMBODIMENTS

Figure 1:
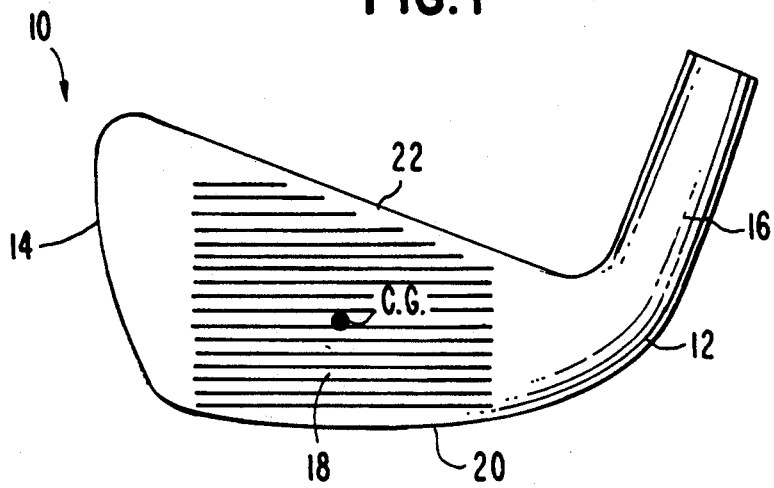

Reference will be made in detail to the present preferred embodiments of the invention, examples of which are illustrated in the drawings. The same or like reference numerals will be used throughout the drawings to refer to the same or like parts.

Figure 2:
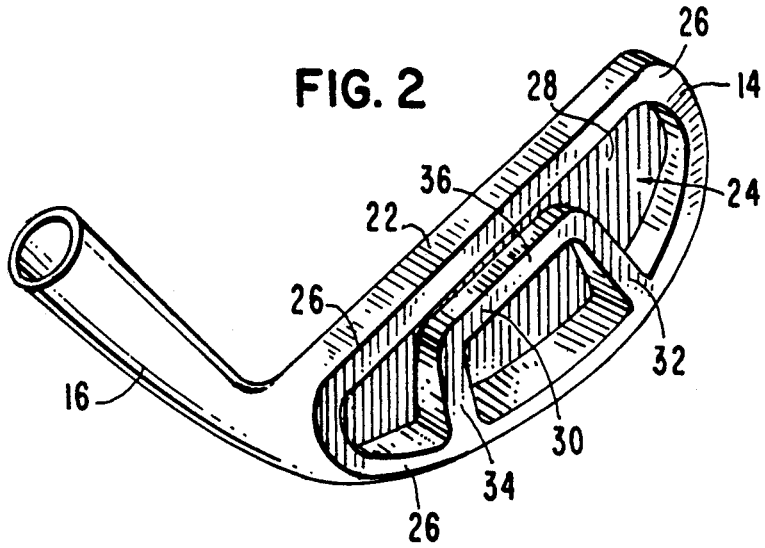
Figure 3:
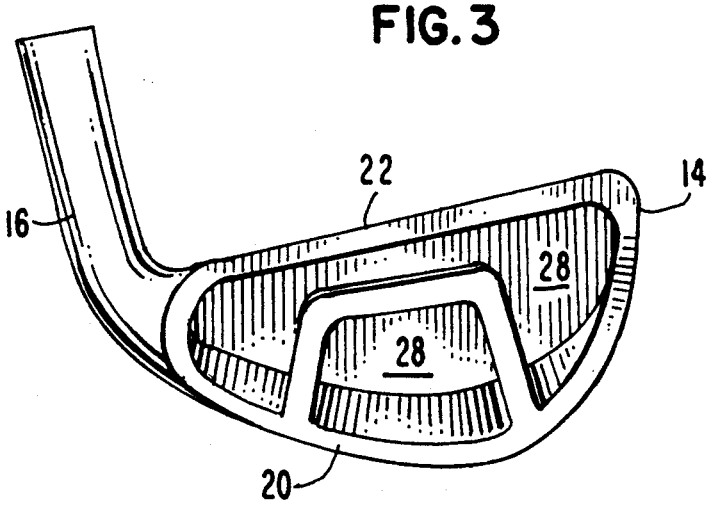

FIGS. 1 to 3 illustrate one embodiment of an iron type golf club head 10 of the present invention including a heel 12, toe 14, hosel 16, ball striking face 18, bottom 20 and top ridge 22. The club head includes a center of gravity (CG) shown on the ball striking face 18 which is located at approximately the center of the club head, and is the spot where a ball ideally should be struck to provide maximum distance and control. The club head includes a rear cavity 24 defined by a peripheral weight 26 which extends around the periphery of the club head 10. The bottom of the cavity forms a rear surface 28 and the peripheral weight 26 extends rearwardly from the rear face 28 to form the cavity 24. A secondary weight member 30, in the form of a U-shaped mass includes legs 32 and 34 and a base 36 which extends into the cavity 24. The legs 32 and 34 are connected at two points to the peripheral weight member 36 adjacent the bottom surface 20 of the club head 10. The base 36 of the weight member 30 is spaced from the peripheral weight 26 adjacent the top ridge 22 of the club head 10. The secondary weight member 30 is generally disposed about the center of gravity (CG) to concentrate weight in this area and also to maximize the energy transfer between the club head and ball when the ball is struck slightly off of the center of gravity (CG).

Figure 4:
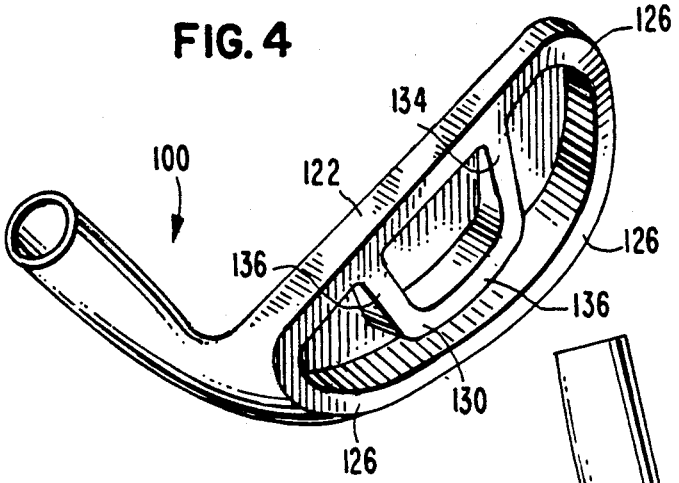
Figure 5:
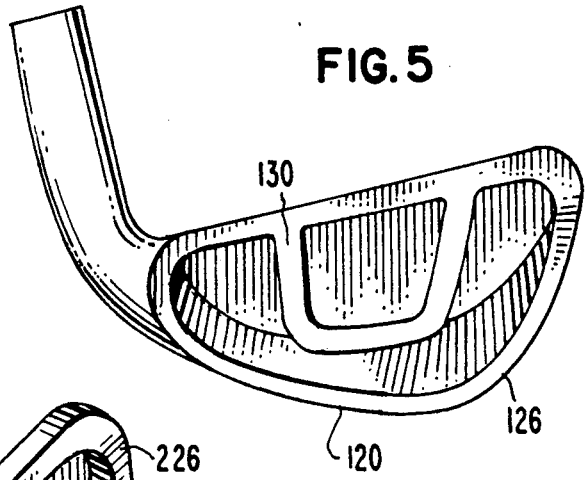

FIGS. 4 and 5 illustrate another embodiment of a golf club head 100 of the present invention which is similar to the embodiment shown in FIGS. 1 to 3 except for the rear weight configuration. The club head 100 includes a peripheral weight 126 located within the cavity 124. In this embodiment, the secondary weight member 130 includes a pair of legs 132 and 134 which are integrally connected to the peripheral weight 126 adjacent the top ridge 122 and extend downwardly within the cavity 124 to a base member 136 which is formed spaced from the peripheral weight 126 adjacent the bottom surface 120. As with the first embodiment, the secondary weight member 130 is positioned about the center of gravity (CG) to maximize energy transfer between the club head and a golf ball when the ball is struck in the center of gravity (CG), or slightly away from the center of gravity (CG).

Figure 6:
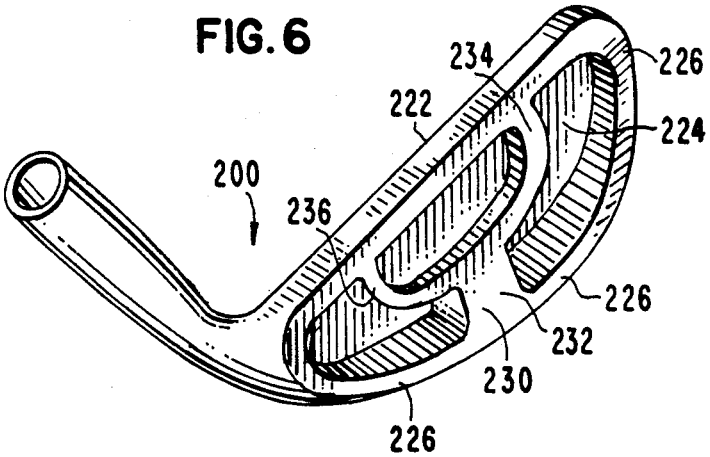
Figure 7:
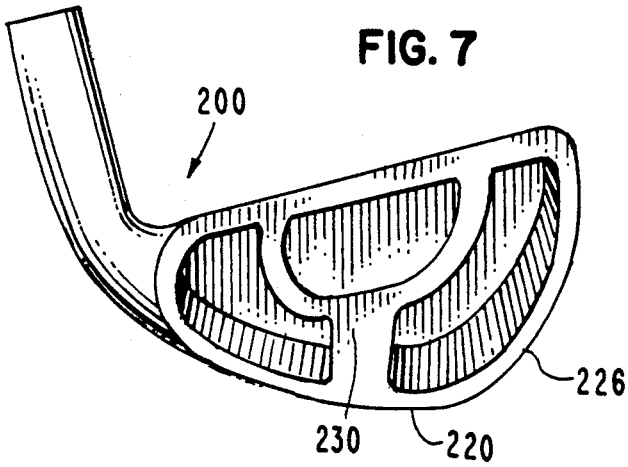

FIGS. 6 and 7 show a third embodiment of a golf club head 200 of the present invention including a bottom surface 220, top ridge 222, cavity 224, peripheral weight 226 and includes a secondary Y-shaped weight member 230 having a base leg 232 integrally attached to the peripheral weight 226 adjacent the bottom surface 220 of the club head and two upper leg members 234 and 236 integrally attached to the peripheral weight 226 adjacent the top ridge 222 of the club head. In this embodiment, the secondary weight 230 is also located about and adjacent to the center of gravity (CG) of the club head.

Figure 8:
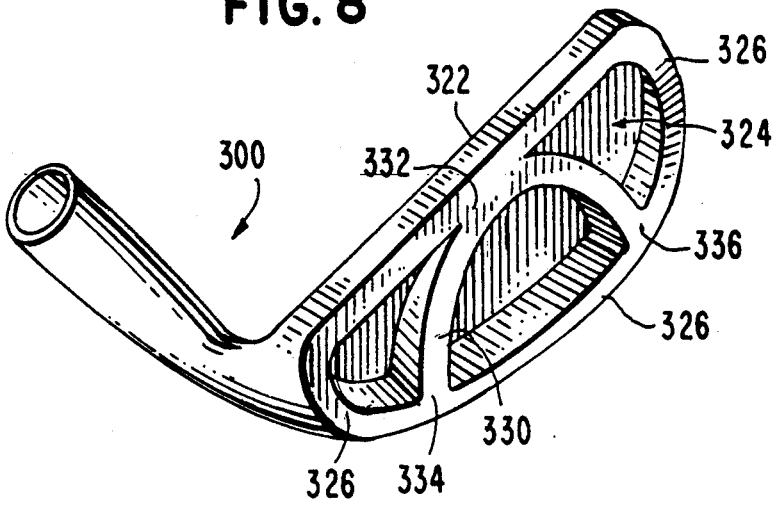
Figure 9:
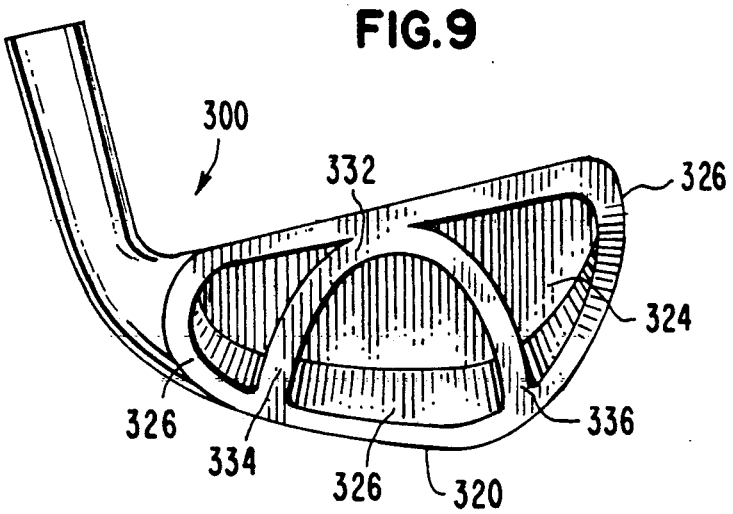

FIGS. 8 and 9 show a fourth embodiment of a golf club head 300 of the present invention including a peripheral weight member 326, a rear cavity 324, a bottom surface 320, a top ridge 322 and a secondary weight 330 which is arcuate in shape. The apex 332 of the arcuate secondary weight 330 is attached to the peripheral weight 326 adjacent the top ridge 322 and the two legs 334 and 336 of the arcuate shaped weight member 330 are attached to the peripheral weight 326 adjacent the bottom surface 320.

The secondary weight 330 is located adjacent to and generally surrounds the center of gravity (CG) of the club head 300.

Figure 10:
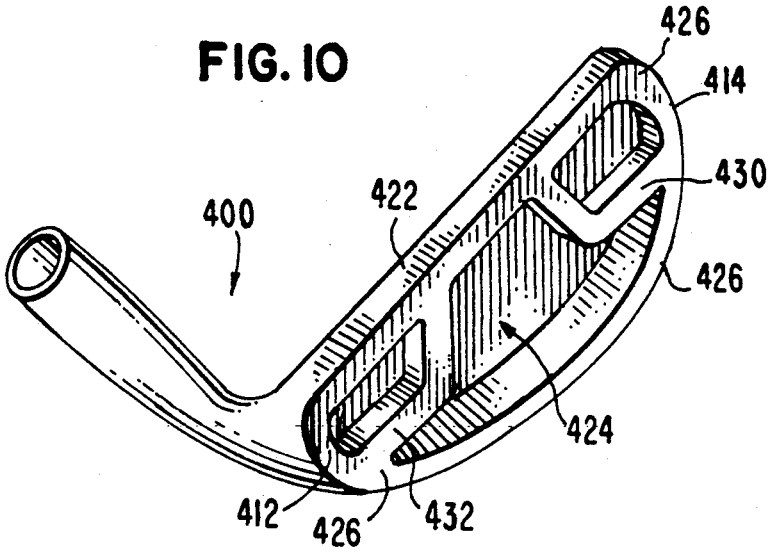
Figure 11:
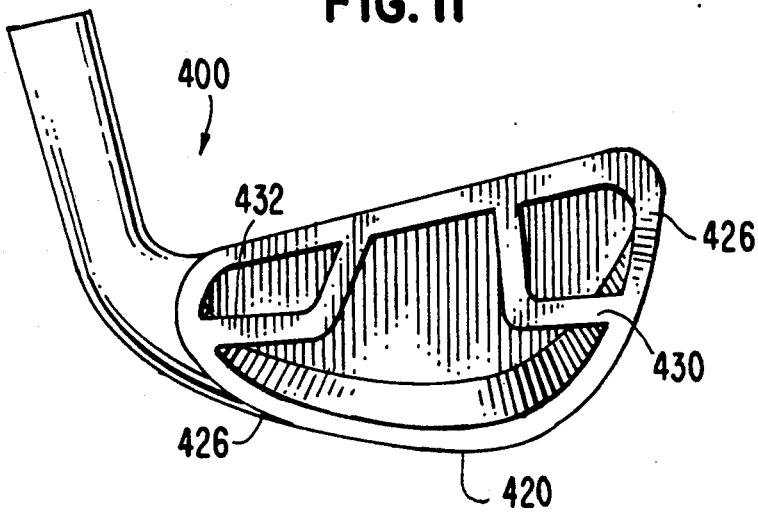

FIGS. 10 and 11 illustrate a fifth embodiment of a golf club head 400 of the present invention including a top ridge 422, bottom surface 420, cavity 424 and peripheral weight 426. In this embodiment, two secondary L-shaped weight members 430 and 432 are shown formed within the rear cavity 424. Secondary weight member 430 has one leg attached to the peripheral weight 426 adjacent the top ridge 422 and a second leg attached to the peripheral weight member 426 adjacent the toe 414. Weight member 432 has one leg attached to the peripheral weight 426 adjacent the top ridge 422 and a second leg attached to the peripheral weight member 426 adjacent the heel 412. In this embodiment, the secondary weight members 430 and 432 are spaced further toward the toe 414 and heel 412 respectively.

Figure 12:
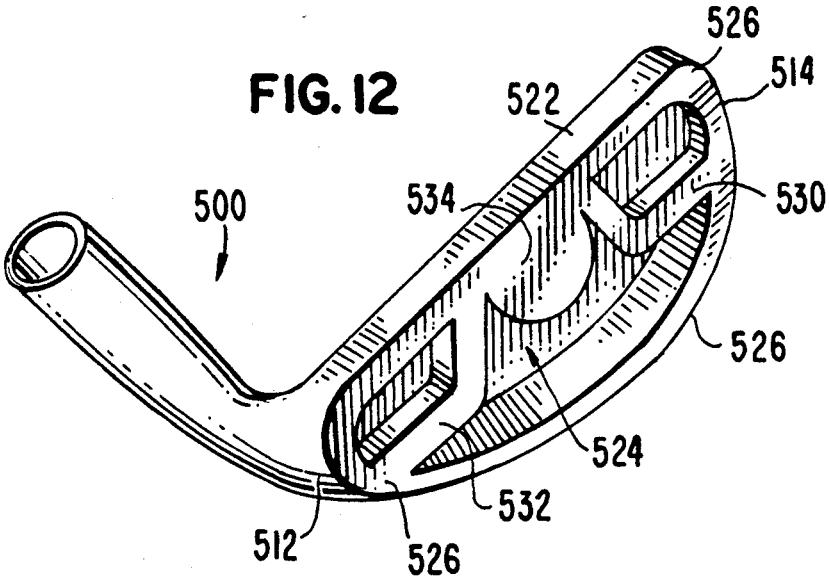
Figure 13:
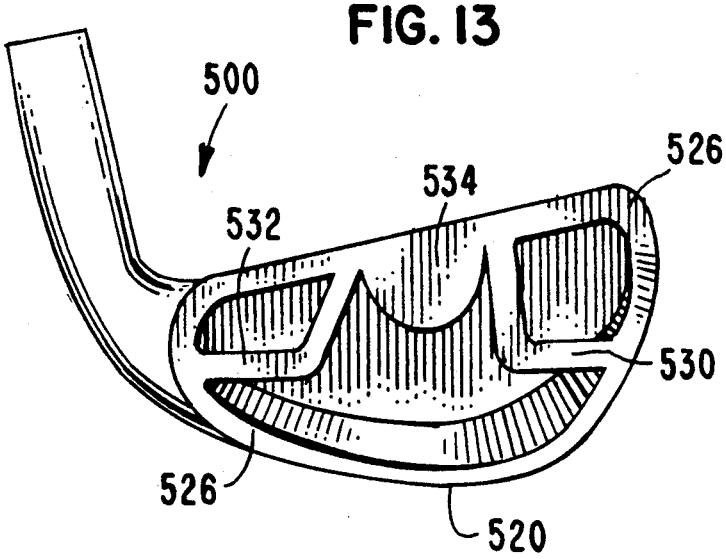

FIGS. 12 and 13 show a sixth embodiment of a golf club head 500 of the present invention including a bottom surface 520, top ridge 522, rear cavity 524 and peripheral weight 526. In this embodiment, secondary weight members 530 and 532 are located within the cavity 524.

Secondary weight member 530 includes a first leg attached to the peripheral weight adjacent the top ridge 522 and a second leg attached to the peripheral weight member 526 adjacent the toe 514. Weight member 532 includes a first leg attached to the peripheral weight member 526 adjacent the top ridge 522 and a second leg member attached to the peripheral weight member 526 adjacent the heel 512. Another third secondary weight member 534 is semi-hemispherical in shape, and integrally formed with peripheral weight 526 adjacent the center of the top ridge 522 and extends downwardly within the cavity 524 between secondary weight members 530 and 532.

In the above embodiments, the secondary weight members are molded or otherwise manufactured integrally with the golf club head design as a single unit. The invention, however, obviously contemplates designs wherein the secondary weight members are attached to the club head by various conventional fastening means. Although the golf club head is described with respect to the specific embodiments described hereinabove, the invention may include various changes and/or modifications without departing from the spirit and scope of the invention as defined by the apended claims.

I claim:

1. An iron type golf club head including a hosel, heel, toe, bottom sole, top ridge, rear surface, ball striking face having a center of gravity thereon, a peripheral mass formed on said rear surface along an entire outer periphery thereof and defining a centrally located cavity formed within said peripheral mass wherein the improvement comprises:

a U-shaped secondary weight member formed entirely within said cavity defined by a pair of leg elements and a base element connected in a U-shaped configuration, said leg elements having first ends integrally attached to the peripheral mass at two spaced points along said peripheral mass and said base element being spaced from said peripheral mass, said cavity being void both within, and outside of a perimeter defined by said U-shaped secondary weight member.

2. The golf club head of claim 1, wherein said base elements extends in a heel to toe direction, and said leg elements extend in a direction between said top ridge and said bottom sole.

3. The iron type golf club head of claim 1 wherein said leg elements of said secondary weight member are attached to said peripheral mass adjacent the top ridge of the club head.

4. The iron type golf club head of claim 1 wherein said leg elements of said secondary weight member are attached to said peripheral mass adjacent the bottom sole of said golf club head.

5. The iron type golf club head of claim 1 wherein said base of said U-shaped secondary weight member extends in a line in a heel to toe direction within said cavity on said club head.

6. An iron type golf club head formed with a center of gravity including a hosel, heel, toe, bottom sole, top ridge, rear surface, ball striking face, a peripheral mass formed on said rear surface, along an entire outer periphery thereof and defining a centrally located cavity formed within said peripheral mass, wherein the improvement comprises:

a secondary weight member formed entirely within said cavity and having a Y-shape with a pair of upper legs and a lower leg, the ends of said upper legs being integrally attached to said peripheral mass at two spaced points adjacent said top ridge and said lower leg being integrally attached to said peripheral mass adjacent said bottom sole, said cavity being void both within, and outside of a perimeter defined by said Y-shaped secondary weight member.

7. An iron type golf club head formed with a center of gravity including a hosel, heel, toe, bottom sole, top ridge, rear surface, ball striking face, a peripheral mass formed on said rear surface along an entire outer periphery thereof and defining a centrally located cavity formed within said peripheral mass, wherein the improvement comprises:

a secondary weight member formed entirely within said cavity and having an arcuate shape, and having ends which are integrally attached to said peripheral mass at two spaced points adjacent said bottom sole and an apex which is integrally attached to said peripheral mass adjacent said top ridge, said cavity being void both within, and outside of a perimeter defined by said arcuately shaped secondary weight member.

8. An iron type golf club head formed with a center of gravity including a hosel, heel, toe, bottom sole, top ridge, rear surface, ball striking face, a peripheral mass formed on said rear surface along an entire outer periphery thereof and defining a centrally located cavity formed within said peripheral mass, wherein the improvement comprises:

a secondary weight system formed entirely within said cavity and including a pair of weight members including a first secondary weight member having a first leg attached to said peripheral mass adjacent said top ridge and a second leg attached to the peripheral mass adjacent the toe and a second secondary weight member including a first leg attached to the peripheral mass adjacent the top ridge and second leg attached to the peripheral mass adjacent the heel, said cavity being void within perimeters defined by each of said first and said second secondary weight members.

9. The golf club head of claim 8 including a third secondary weight member attached to said peripheral mass adjacent said top ridge and located between said first and second secondary weight members.

10. The iron golf club head of claim 9 wherein said third secondary weight member is semi-hemispherical in shape.

* * * * *